United States Patent [19]

Van Cleave, Eugene H. et al.

[11] Patent Number: 4,566,304

[45] Date of Patent: Jan. 28, 1986

[54] SHEET METAL BENDING BRAKE

[75] Inventors: Van Cleave, Eugene H., Orchard Lake; Douglas G. Break, Farmington Hills, both of Mich.

[73] Assignee: Van Mark Products Corporation, Farmington Hills, Mich.

[21] Appl. No.: 458,958

[22] Filed: Jan. 18, 1983

[51] Int. Cl.[4] ..... B21D 5/04

[52] U.S. Cl. ..... 72/319; 269/236

[58] Field of Search ..... 72/319–323, 72/316, 293; 269/236, 239, 157, 233

[56] References Cited

U.S. PATENT DOCUMENTS

| | | | |
|---|---|---|---|
| 128,902 | 7/1872 | Pinkham | 269/239 |
| 135,883 | 2/1873 | Bonney | 269/236 |
| 187,962 | 3/1877 | Cantrell | 269/236 |
| 344,713 | 6/1886 | Blythe | 269/236 |
| 824,007 | 6/1906 | Gordon | 269/236 |
| 952,013 | 3/1910 | Mignola, Jr. | 269/236 |
| 1,084,236 | 1/1914 | Siderits et al. | 269/236 |
| 1,871,874 | 8/1932 | Bazzoni | 269/236 |
| 2,788,687 | 4/1957 | Ridge | 269/239 |
| 3,129,938 | 4/1964 | Riley | 269/236 |
| 3,383,899 | 5/1968 | Ercoline et al. | 72/319 |
| 3,944,200 | 3/1976 | Huntley | 269/233 |
| 4,081,986 | 4/1978 | Break | 72/320 |
| 4,092,841 | 6/1978 | Chambers, Jr. | 72/320 |

FOREIGN PATENT DOCUMENTS

| | | | |
|---|---|---|---|
| 663522 | 4/1929 | France | 269/239 |

*Primary Examiner*—Daniel C. Crane

*Attorney, Agent, or Firm*—Hiram P. Settle

[57] ABSTRACT

A portable sheet metal bending brake of enhanced clamping and bending capacity and wherein a cam-actuated clamping structure is provided. The brake includes a plurality of upstanding structural castings which are partially bifurcated to pivotally support upper clamping arms cooperable with lower, casting-mounted workpiece support and bending elements. The bifurcated castings also provide support for a cam shaft on which individual cams are fixed for clamping contact with the clamping arms. The cam clamping force exertible on each arm cam be individually adjusted through a slide plate mounted on the arm and movable to vary the precise cam-arm contact point. Thus, the brake can be assembled completely and the cam plates individually adjusted to ensure uniform clamping of the workpiece along the entire length of the brake.

5 Claims, 4 Drawing Figures

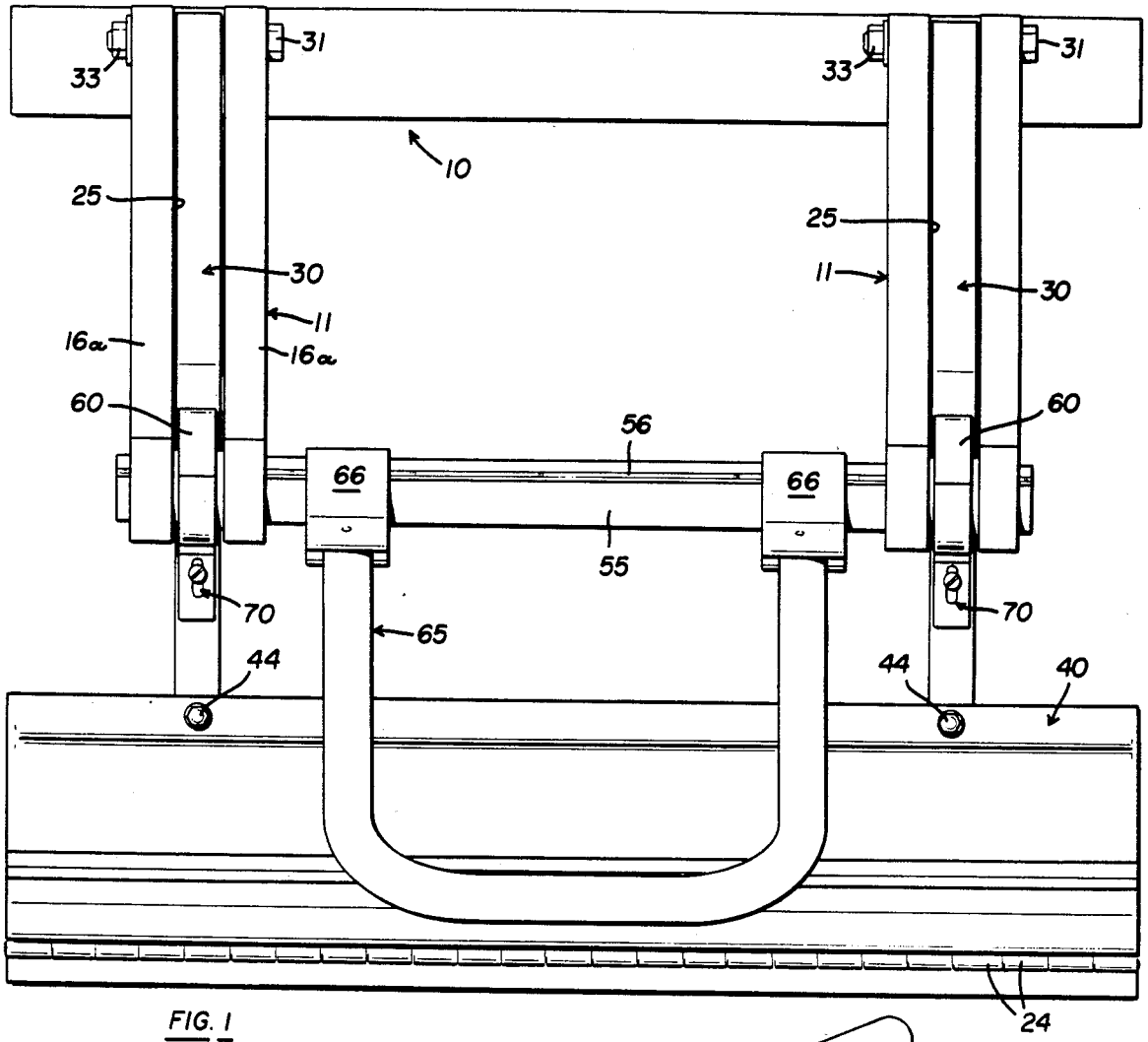
FIG. 1
FIG. 2
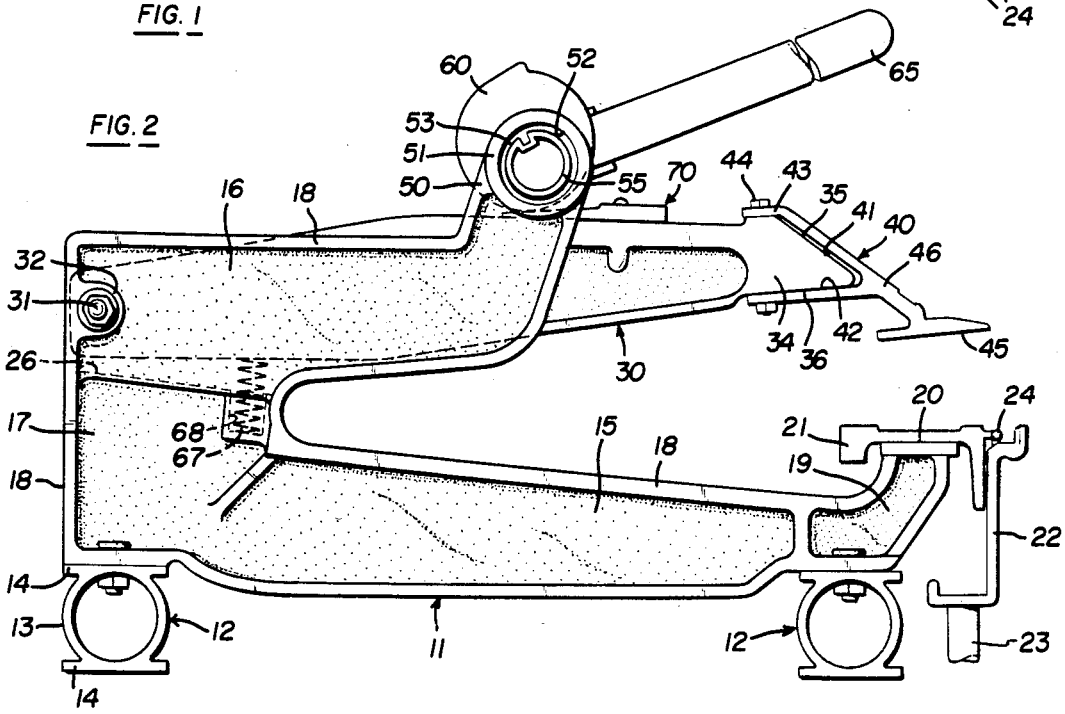

SHEET METAL BENDING BRAKE

BACKGROUND OF THE INVENTION

Portable sheet metal bending brakes are utilized in the bending of relatively thin gauge sheet metal material, such as aluminum siding, and must be portable, yet rugged for transport. The brakes usually are constructed of an array of "C"-shaped main castings held in assembly by an appropriate frame, the castings being provided with a clamping and bending structure by which the sheet metal is clamped and bent at the open ends of the "C" castings. Various structures have been proposed to clamp the workpiece in position, typically by a transverse slide mechanism as shown in the prior art, e.g., Rowan et al U.S. Pat. No. 3,147,791 or Marsh U.S. Pat. No. 3,161,223. Where the bending of thick workpieces is attempted, the "C" castings deflect and open up, so that the workpiece is not firmly held in position for bending. As a result, the utility of such prior art brakes has been severely limited in terms of the thickness of material which can be bent.

Various other types of clamping mechanisms have been proposed for increasing the gauge of the metal which can be bent. For example, Barnack U.S. Pat. No. 3,481,174 proposes an over-center clamping mechanism, but the close tolerances necessary to an adequate over-center clamp has made this structure difficult to manufacture and maintain under actual operating conditions in the field. Another attempt at a different clamping structure is shown in Break U.S. Pat. No. 4,081,986, where a cam locking structure is provided. This cam-actuated brake utilized a segmented shaft arrangement with a single clamping arm adjacent a single casting with the cam, in effect, cantilevered from the casting on a small pivot pin. This proposed brake suffers from various structural deficiencies and has never been commercially acceptable. Also, difficulties are encountered in maintaining a constant clamping load along the entire brake length.

A need exists in the art for a rugged, portable sheet metal bending mechanism which can bend heavier gauge material, which can bend such material at angles in excess of 90° to 105°, and which can make complex, hemmed, or deep section bends of the type desirable in present construction techniques.

BRIEF DESCRIPTION OF THE PRESENT INVENTION

The present invention now provides a new and novel cam-actuated brake in which the previous transversely slidable locking mechanism is eliminated and in which the primary structural castings do not tend to deflect or open upon the bending of thicker gauge metal.

More specifically, the present invention proposes the utilization of a plurality of castings which are generally "U"-shaped, but in which the upper arm terminates short of the lower arm to support a cam locking mechanism operable upon a separate pivoted clamping arm. The primary castings thus provide, at their lower forward edge a support for a continuous clamping plate provided with a pivoted bending leaf, much as in the present, conventional prior art designs. The upper arm of the casting terminates short of the lower arm and is bifurcated vertically to provide a vertical slot within which is positioned a movable clamping arm pivoted to the primary casting adjacent the rear edge thereof. The clamping arm projects forward from this pivot location through the primary casting slot and toward the clamping location. The arms are joined by a continuous upper clamping element which overlies and clampingly cooperates with the lower, casting-retained clamping element. The clamping arm, when lowered, moves the continuous upper clamping element into clamping engagement with the workpiece as it is positioned on the lower clamping element.

The fixed upper arm of each casting carries a continuous cam shaft which is coextensive with the brake, and this cam shaft is journalled in upper arm in bearings carried by the bifurcated upper arm with shaft-mounted cams interposed between the bifurcations. Thus, the cam shaft and the cams are carried in closely spaced bearings giving adequate support to the shaft and the cams. One cam is provided for each clamping arm.

The clamping arm preferably underlies the cam, and the cam bears upon the upper arm to urge it downwardly to its clamping position. The arm may be urged upwardly into contact with the overlying cam by spring means interposed between the clamping arm and the adjacent fixed portion of the lower casting arm. The shaft is provided with a handle by means of which the shaft can be rotated to move the cam rotationally to urge the clamping arm downwardly against the bias of the spring.

In the preferred embodiment of the invention, the cam shaft is elevated relative to the remainder of the casting so that the clamping arm can be urged by the spring to an upper, fully open position providing full access to the space between the cam arm and the lower casting arm, thereby providing for the manufacture of complicated, multi-bend structural shapes. Further, the elevated cam shaft and its location medially of the clamping arm provides clearance for substantial over-bends, i.e., greater than 105°.

The cams are each fixedly attached to the shaft for corotation therewith, preferably by fixed tongue-and-groove connections, so the cams are not adjustable rotationally relative to the shaft. Due to manufacturing tolerances, some adjustment between each cam and its associated clamping arm is essential to ensure full clamping contact between the clamping element and the casting clamping element throughout the entire length of the brake. This adjustment is provided by a slide plate mounted on the upper surface of the arm and, in effect, interposed between the cam and the arm. This slide plate has an inclined upper surface and is adjustable longitudinally along the length of the clamping arm. By adjusting the clamping plate longitudinally, different inclined portions of its upper surface are aligned with the cam to be contacted by the cam surface, and a precise adjustment of the contact point between the cam and the clamping arm can be obtained after the brake is completely assembled.

Thus, the present invention provides a new and novel cam-actuated sheet metal bending brake capable of enhanced clamping loads. The clamping arm is supported between the bifurcations of the casting to ensure an adequate, non-cantilevered pivot location for the arm. The shaft is similarly journalled on the bifurcated casting, so that each cam is supported at each side in the bearings carried by the associated casting, and the cam is supported directly over the point at which force is to be applied to the arm. Since the cams are fixed rotationally to the shaft, there is no possibility of relative cam-shaft rotation and misalignment. The precise contact point between the cam and the arm is provided by the slide plate, and this precise point is adjusted after the brake is completely assembled and after the adequacy of clamping upon initial adjustment can be visually determined.

ON THE DRAWINGS

FIG. 1 is a plan view of a sheet metal bending brake of the present invention;

FIG. 2 is a side elevational view of the brake of FIG. 1;

AS SHOWN ON THE DRAWINGS

Figure 4:
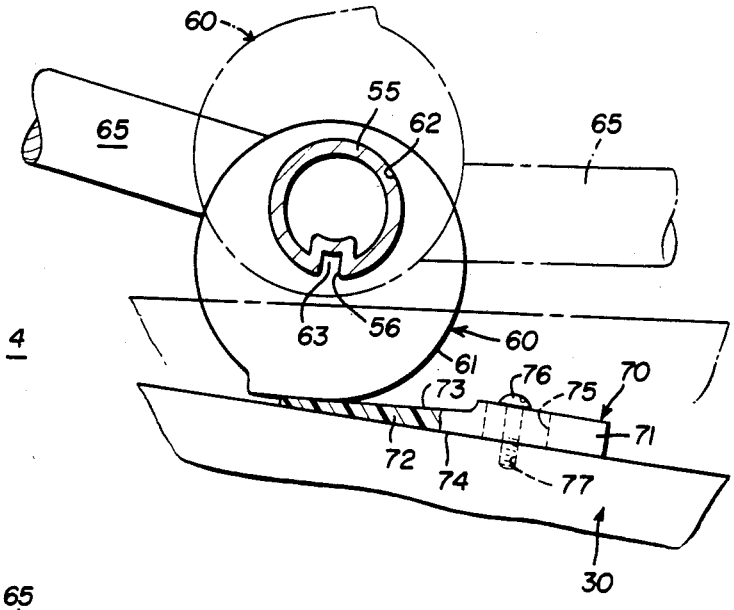
FIG. 4 is an enlarged, somewhat diagrammatic illustration of a portion of the brake illustrating the manner of adjusting the area of cam-arm contact.

In FIG. 1, reference numeral 10 refers generally to a brake of the present invention. For purposes of illustration, a relatively small brake having only two primary castings and an overall length on the order of 2½ feet is illustrated. It will be appreciated that commercial brakes generally are larger than that illustrated in FIG. 1, but such larger brakes are simply multiples of that illustrated in FIG. 1, and the construction and the principles of operation of such larger brakes are identical with that illustrated.

In greater detail, the brake of FIG. 1 comprises a pair of primary castings 11 which are bolted or otherwise secured in assembly to lower frame rails 12 extending longitudinally of the brake and generally underlying the brake. The frame rails 12 have generally circular central sections 11 provided with horizontally projecting, longitudinally coextensive flanges 14 providing flat upper and lower surfaces and also reinforcing the circular central section against deflection. The frame rails 12 abut the undersurface of the lower casting arm 15 which is integral with an upper casting arm 16 which is somewhat shorter than the lower arm 15 and which is joined thereto by a vertical bight or joining portion 17. The lower arm 15 and the upper arm 16 have their perimeters defined by outwardly directed reinforcing flanges 18 for structural rigidity, and the arms are typically aluminum castings made in suitable permanent molds or die cast molds, if desired.

The lower arm 15 terminates in an upturned forward portion 19 surmounted by a horizontal, planar mounting surface 20. Mounted on this planar surface 20 and secured thereto by suitable means, such as bolts (not shown), is a clamping plate 21, preferably formed as a continuous extrusion of an extent greater than the spacing between the two castings 11. Pivoted to the forward end of this clamping plate 21 is a bending leaf 22 provided with a depending "U"-shaped handle 23. The bending leaf 22 is also preferably formed as an extrusion and is coextensive with the clamping element 21, the leaf 22 and the clamping element 21 being interconnected by a hinge pin 24 as is conventional in the art, for example, as illustrated in U.S. Pat. No. 3,877,279 and U.S. Pat. No. 4,081,986.

The upper arm portion 16 of each casting 11 overlies the lower arm portion 15, but terminates short of the upturned forward end 19 thereof. The upper arm portion 16 is provided with a vertical slot 25, the bottom of the slot being indicated by the dotted line 26 of FIG. 2. By virtue of the slot 25, the upper arm 26 is bifurcated, each bifurcation being reinforced by its marginal laterally projecting flanges 18. The bifurcated upper arm portions 16*a* (FIG. 1) are parallel to one another, are coextensive, and cooperatively define the slot 25 therebetween. Mounted in the slot 25 of the bifurcated upper arm 16 of the casting 11 is a clamping arm indicated generally at 30, one clamping arm being provided for each casting 11. The arms are preferably castings of aluminum, and, again, are provided with reinforcing marginal flanges. The rear end of each arm 30 is pivoted to the associated casting by means of a pivot bolt 31 which laterally traverses the slot 25, the bolt being located in reinforcing bosses 32 formed on each of the arm bifurcations 16*a*, and the bolt being retained by a nut 33. The rear portion of the arm 30 is apertured to receive the bolt 31, and this aperture is provided with a suitable sleeve-type bearing through which the bolt 31 projects.

The arm 30 projects forwardly from the pivot bolt 31 between the bifurcations 16*a* and forwardly of the forward extremity of the bifurcations 16*a* to terminate in a forward, relatively heavy nose portion 34 having a forwardly and downwardly inclined front surface 35 and a lower flat surface 36 providing angularly related clamping surfaces. Mounted at the forward extremity 34 of the arm 30 is a continuous clamping element 40 having rearwardly facing relatively inclined upper and lower clamping surfaces 41 and 42, respectively, for engagement with the clamping surfaces 35 and 36, respectively, of the arm 30. The upper surface 41 of the clamping element 40 terminates in a rearwardly projecting, continuous portion 43 closely overlying the adjacent surface of the arm 30 and a vertical bolt 44 passes through the rear portion 43 and the lower portion of the clamping element 40 and the forward portion 34 of the arm 30 to clamp the clamping element 40 in fixed assembly on the arms 30.

The clamping element 40 is coextensive laterally with the lower clamping element 21 which is secured to the lower casting arm 15, and the clamping element 40 has a lower clamping surface 45 formed on the underside of a forwardly and downwardly projecting carrying portion 46. It will be seen that lowering of the arm 30 from its position of FIG. 2 to its actuated position of FIG. 3 will lower the surface 35 into clamping relationship with the upper surface of the lower clamping element 21 to clamp a workpiece (not shown) therebetween for bending when the bending leaf 22 is elevated by its handle 23.

The upper arm 16 of the casting 11 is provided at its forward end with an upstanding protuberance 50, this protuberance being provided on each bifurcation 16 at the forward end thereof. The protuberance or embossment 50 of each bifurcation 16 terminates in a cylindrical, upwardly directed bearing projection 51 which surrounds a cylindrical bearing aperture 52. Bearing apertures 52 of the bifurcation 16*a* of each upper arm portion 16 are laterally aligned and are provided with appropriate bearing sleeves 53 which are individual to each protuberance 51 and in which is journalled a tubular shaft 55 which is continuous to bridge the castings 11. The shaft 55, as perhaps best shown in FIG. 4 of the drawings, is a generally cylindrical element, preferably formed as an extrusion of aluminum, having a locking recess 56 formed in its periphery, this recess extending axially throughout the full extent of the shaft 55.

A cam 60 is interposed between the bifurcation 16*a* of each upper arm portion 16, as best shown in FIG. 1, and each cam is mounted on the shaft 55 to be corotatable therewith. Corotation of the shaft 55 and each of the cams 60 is ensured by the design of the cam. Each cam has a helical periphery 61 and a cylindrical aperture 62 eccentric with the surface 61 and of a size to snugly receive therein the shaft 55. An integral projection 63 is provided in each cam, this projection extending radially inwardly of the aperture 62 and being of a size and shape to be snugly received within the shaft recess 56. Since each cam 60 is of identical contour, shape and size, and since each cam 60 bears a projection 63 which is receivable in the shaft recess 56, it will be seen that each cam is accurately positioned in the same relative rotatable position upon the shaft 55 when the projection 63 is received in the recess 56.

To assemble the shaft and the cam in the brake, and referring specifically to FIG. 1 of the drawings, the cams 60 are positioned between each pair of bifurcations 16*a* and the shaft then is simply inserted through the bifurcation bearing sleeves 53, through the cam 60, and through the next successive bifurcation bearing 53. As the cam shaft is inserted axially, each cam is accurately positioned on the shaft. A handle for manually rotating the shaft 55 and the cams affixed thereto is provided as best illustrated in FIG. 1. The handle 65 is "U"-shaped in configuration, with the two legs of the handle being secured to the shaft 55 by fittings 66 having projections insertible into the shaft grooves 56 (not shown) to affix the handle 65 to the shaft 55 in the desired position.

Figure 3:
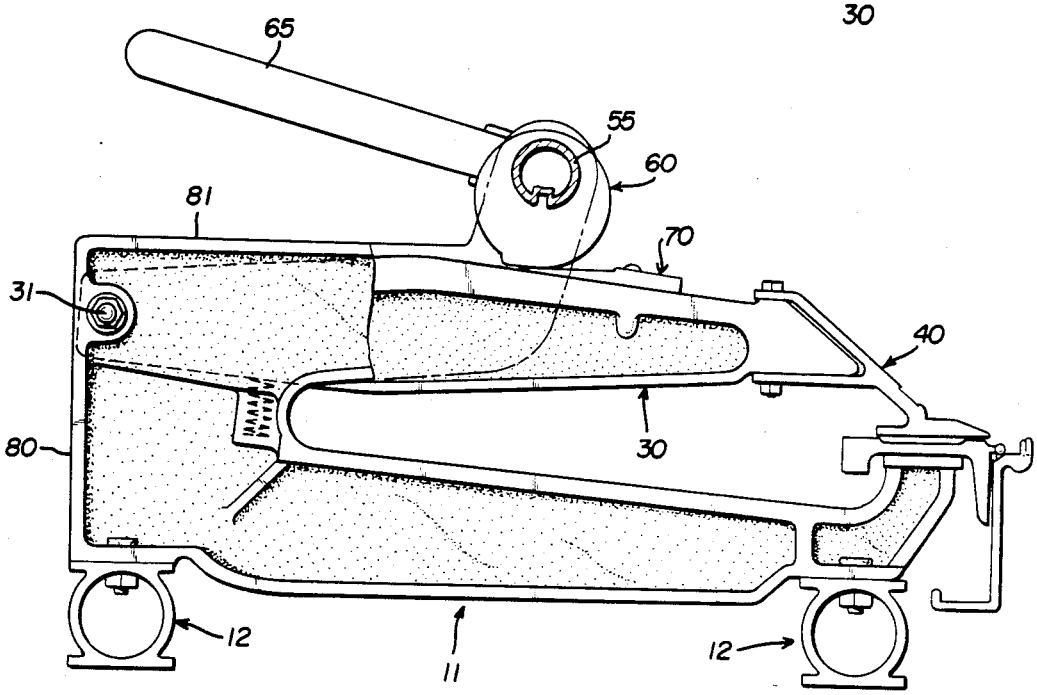
FIG. 3 is a side elevational view similar to FIG. 2, but showing the brake in an adjusted position.

It will be seen from FIGS. 2 through 4 that the shaft 55, the cams 60 and the handle 65 are all positioned above the clamping arms 30. Each of the clamping arms 30 is urged upwardly into engagement with the undersurface of the cam 60 by a compression spring 67 located in an open-topped, cylindrical pocket 66 formed in the lower arm 15 of the casting 11 between the bifurcations 16*a* and in alignment with the arm 30. The compression spring 67 contacts the undersurface of the arm 30 and resiliently biases the arm upwardly into contact with the undersurface of the cam 60.

From the foregoing, it will be appreciated that each cam 60 is fixedly secured to the shaft 55 against rotation, and each cam is fixed against axial displacement on the shaft since the cam is interposed between the bifurcations 16*a* of the upper arm 16. The shaft, when assembled, is retained axially in position by appropriate means, such as snap rings (not shown). While this arrangement ensures corotation of the cam with the shaft as the shaft is axially rotated by the handle 65, it is necessary to provide some adjustment of each arm 30 relative to its associated cam 60 in order to ensure adequate clamping of a workpiece between the clamping elements 21, 40. Since brakes are manufactured in lengths of up to 12 to 15 feet, and multiple castings 11 are required, the same clamping force must be exerted on each clamping arm 30 to ensure adequate clamping of the workpiece.

In the present invention, this is accomplished by means of a movable cam contact plate 70 interposed between each arm 30 and the associated cam, as best illustrated in FIG. 4 of the drawings. A cam contact plate 70 is provided for each clamping arm 30, and each plate includes a forward rectangular retaining portion 71 and a rearwardly projecting contact portion 72 having an upwardly directed, inclined contact face 73 which tapers to a minimal thickness toward the rear of the contact arm 30. The undersurface 74 of the contact plate 70 is planar and is in full surface contact with the exposed upper surface of the associated clamping arm 30. The clamping portion 71 of the contact plate 70 is provided with a longitudinally elongated slot 75 through which a threaded bolt 76 extends for threaded retention in a threaded aperture 77 formed in the arm 30. By loosening the bolt 76, the contact plate can be adjusted longitudinally of the arm 30; when the bolt is tightened, the contact plate 70 is retained in fixed position on the arm 30.

The contact plate 70 is positioned on the arm 30 directly beneath the associated cam 60 with the tapered portion 72 of the contact plate being interposed between the cam 60 and the upper surface of the arm 30 and with the cam periphery 61 contacting the tapered surface 73 of the contact plate. It will be apparent that displacement of the plate 70 relative to the arm 30 in a leftward direction (as viewed in FIG. 4) will interpose a thicker portion of the tapered portion 72 of the contact plate 70 between the cam 60 and the arm 30, so that actuation of the cam will displace the arm downwardly to a greater extent. Conversely, movement of the plate 70 is a rightward direction will result in a lesser depression of the arm 30 when the cam is positioned as illustrated in FIG. 4.

By utilization of the slidable contact plates 70, it is possible to assemble the brake completely with the cams in position overlying the plate 70 and the arm 30. The handle is then actuated to rotate the cam to its illustrated positions in FIGS. 3 and 4 at which the cam surface depresses the arm 30 to clamp a workpiece between the clamping elements 40 and 21. The clamping elements 40 and 21 are then visually inspected and perhaps a test bending operation carried out to determine whether uniform clamping loads are imposed along the entire length of the clamping elements 40 and 21. If one or more of the cams 60 is not urging the arm downwardly to an extent sufficient to ensure firm clamping of a workpiece, the slide plate 70 for that arm is adjusted by simply releasing the bolt 76, sliding the contact plate 70 to the left to a position to ensure full clamping depression of the arm 30 and the bolt 76 is retightened in its adjusted position. Conversely, where too great a clamping effect is obtained at one or more arms 30, the contact plate 70 of the corresponding arm is moved to the right to lessen the clamping effect.

Referring to FIGS. 2 and 3, it will be seen that the castings 11 are of a size and contour to provide a flat back supporting surface 80 upon which the brake may be positioned for transport and to provide flat upper surfaces 81 rearwardly of the upper protuberances 50 in which the shaft 55 is journalled. Further, the protuberances 50 provide a means whereby the shaft 55 and the cams 60 are supported above the planar casting surfaces 81 yet in a position directly overlying the clamping arms 30. The handle is illustrated in FIG. 2 of the drawings in its forward position at which the clamping arms 30 are elevated by the compression springs 67 against the undersurface of the cams 60, and the handle is shown in FIG. 3 in its fully locked position, the handle extending rearwardly above and in spaced relation above the surfaces 81. Even when the handle 81 is in its rearmost position of FIG. 3, it is positioned sufficiently above the surfaces 81 so that the surfaces may provide support for a supporting shelf secured to the surfaces 81 and bridging the castings 11. This shelf may be used for the storage of sheet metal material to be worked upon or previously formed sheet metal material, and the shelf may either simply gravitationally rest upon the surfaces 81 or may be secured thereto by any suitable means.

Further, it will be noted that the upper clamping element 40 is supported in cantilevered position by the arms 30 and that the clamping surface 45 is located well forward of the ends of the clamping arms 30. This arrangement accommodates substantial overbending of sheet material clamped between the elements 40 and 21, and this overbending is further accommodated by the location of the cams and cam shaft medially of the arms 30 and by the rearward positioning of the clamping handle 65 when the brake is clamped as illustrated in FIG. 3 of the drawings. Also, the location of the cams 60 medially of the clamping arms ensures the opening of the clamping element 40 upwardly to an extent such that previously formed or bent portions of a workpiece can be inserted between the clamping elements 21, 40 for further bending by the bending leaf 22.

It is claimed:

1. In a sheet metal bending brake having at least two laterally spaced prime support elements and frame means fixedly securing said elements in assembly, each element including (a) a lower arm portion terminating in a horizontal support surface for a sheet metal workpiece and a hinged bending leaf underlying said workpiece, and (b) an upper arm portion terminating short of said horizontal support surface; the improvements of a clamping arm for each prime support element with each arm having one end pivotally secured to said prime support element and its other end projecting toward said horizontal support surface, means on said other end of each clamping arm overlying said horizontal support surface and cooperable therewith for clamping a workpiece therebetween, a rotatable shaft bridging said prime support elements and journalled in the upper arm portions thereof, respectively, cams corotatably secured to said shaft, one cam being aligned with each of said clamping arms, a cam contact plate carried by each clamping arm and having a tapered extension interposed between the associated arm and cam, respectively, and means for slidably and individually adjusting each of said cam contact plates along the associated arm to vary the thickness of the extension interposed between the respective arms and the overlying cams, thereby varying the extent of arm actuation upon rotation of the associated cam.

2. A sheet metal brake as defined in claim 1, wherein the shaft has a groove formed in its exterior periphery to extend axially of the shaft, and each cam has a radial projection extending inwardly into the shaft groove to secure the cam to the shaft for corotation.

3. A sheet metal brake as defined in claim 1, wherein the shaft is tubular and has a peripheral groove extending axially for the entire shaft length, and the cams each have a central bore snugly receiving the shaft and a single inwardly extending projection entered in the shaft groove.

4. In a sheet metal bending brake wherein a plurality of generally "U"-shaped castings are secured in assembly, the castings being secured in aligned horizontal array, each casting including a lower arm portion carrying at its free end a horizontal workpiece support surface coextensive with the casting array and hinged to a coextensive bending leaf and an upper arm portion terminating in spaced relation to said support surface, the improvements of: a workpiece clamping arm adjacent each casting and pivotally connected thereto to project toward the support surface; a clamping element carried by the free projecting ends of said arms for clamping cooperation with said support surface; a rotatable shaft coextensive with the casting array and journalled in the upper arm portions of said castings; a plurality of cams corotatably secured to said shaft in vertical alignment with said clamping arms, respectively; a tapered slide plate mounted on each clamping arm to underlie the corresponding cam, so that the cam contacts said plate upon rotation of said shaft to urge the arm to its clamping position; and means for individually adjusting each said slide plate relative to its arm to vary the effective thickness of the slide plate interposed between the arm and the associated cam.

5. A sheet metal bending brake comprising a plurality of main castings, means securing said castings in spaced, parallel, upstanding array, a fixed horizontal sheet metal support surface joining said castings to be coextensive with said casting array and having a coextensive bending leaf hingedly connected thereto, a horizontal rotatable shaft journalled in said castings, respectively, and extending along said array; a plurality of cams fixed to said shaft for rotation therewith, one such cam being provided for each casting; an elongated clamping arm pivoted to each casting remote from said support surface and projecting toward the casting support surfaces, respectively; a clamping element secured to the free end of each clamping arm and overlying said support surfaces to be coextensible therewith, adjustable cam contact means carried by each clamping arm in vertical alignment with each cam, said contact means each having an abutment surface directly underlying the associated cam; and means for moving each said contact means along the length of its clamping arm towards and away from the pivot to vary the degree of cam rotation necessary for actuation of the associated arm.

* * * * *